United States Patent [19]

Anderson

[11] 4,404,128

[45] Sep. 13, 1983

[54] ENZYME DETERGENT COMPOSITION

[75] Inventor: Barry J. Anderson, Cincinnati, Ohio

[73] Assignee: The Procter & Gamble Company, Cincinnati, Ohio

[21] Appl. No.: 268,215

[22] Filed: May 29, 1981

[51] Int. Cl.[3] ..... C11D 1/10; C11D 3/12

[52] U.S. Cl. ..... 252/546; 252/174.12; 252/174.25; 252/553; 252/558; 252/DIG. 12

[58] Field of Search ..... 252/174.12, 174.25, 252/DIG. 12, 546

[56] References Cited

U.S. PATENT DOCUMENTS

| | | | |
|---|---|---|---|
| 3,451,935 | 6/1969 | Roald et al. . | |
| 3,600,319 | 8/1971 | Gedge et al. | 252/114 |
| 3,650,967 | 3/1972 | Johnson . | |
| 3,723,327 | 3/1973 | van Kampen et al. . | |
| 3,784,476 | 1/1974 | van Kampen et al. . | |
| 4,040,972 | 8/1977 | Roebke et al. | 252/179 |
| 4,274,975 | 6/1981 | Corkill et al. . | |
| 4,303,556 | 12/1981 | Llendado | 252/527 |

FOREIGN PATENT DOCUMENTS

| | | |
|---|---|---|
| 2038103 | 2/1972 | Fed. Rep. of Germany . |
| 2531961 | 2/1976 | Fed. Rep. of Germany . |
| 2539110 | 4/1976 | Fed. Rep. of Germany . |
| 2544019 | 4/1976 | Fed. Rep. of Germany . |
| 2901339 | 7/1979 | Fed. Rep. of Germany . |
| 215 | 1/1979 | United Kingdom . |
| 189078 | of 0000 | United Kingdom . |

*Primary Examiner*—P. E. Willis, Jr.

*Attorney, Agent, or Firm*—Robert B. Aylor; Thomas H. O'Flaherty; Richard C. Witte

[57] ABSTRACT

Detergent compositions comprise a detergent surfactant, a pure enzyme, preferably a proteolytic enzyme, and a mixture of aluminosilicate ion exchange material and water-soluble nitrilotriacetate to provide unobviously superior enzyme cleaning performance.

5 Claims, No Drawings

ENZYME DETERGENT COMPOSITION

TECHNICAL FIELD

Field of the Invention

This invention relates to detergent compositions containing enzymes.

DISCLOSURE OF THE INVENTION

The detergent compositions of this invention comprise:

(a) from about 1% to about 80% of a detergent surfactant;

(b) from about 0.005% to about 0.2% of pure enzyme, preferably a proteolytic enzyme;

(c) from about 5% to about 60% of an aluminosilicate ion exchange material; and (d) from about 1% to about 60% of a water-soluble nitrilotriacetate.

DETAILED DESCRIPTION OF THE INVENTION

The detergent compositions of the present invention contain as essential components a detergent surfactant, an aluminosilicate ion exchange material, an enzyme, and a water-soluble nitrilotriacetate. Preferably, the compositions are substantially free or completely free of phosphate materials. Also, preferably, the compositions are in granular form. However, stable, liquid detergent compositions containing enzymes can be formulated, for example, using the teachings of an application by Letton et al, Ser. No. 201,886, filed Oct. 30, 1980, said application being incorporated herein by reference.

The Surfactant

The detergent compositions herein contain from about 1% to about 80% by weight of an organic surfactant selected from the group consisting of anionic, nonionic, zwitterionic, ampholytic and cationic surfactants, and mixtures thereof. The surfactant preferably represents from about 5% to about 40%, and more preferably from about 10% to about 20%, by weight of the detergent composition. Surfactants useful herein are listed in U.S. Pat. No. 3,664,961, Norris, issued May 23, 1972, and in U.S. Pat. No. 3,929,678, Laughlin et al, issued Dec. 30, 1975, both incorporated herein by reference. Useful cationic surfactants also include those described in U.S. Pat. No. 4,222,905, Cockrell, issued Sept. 16, 1980, and in U.S. Pat. No. 4,239,659, Murphy, issued Dec. 16, 1980, both incorporated herein by reference. However, cationic surfactants are generally less compatible with the aluminosilicate materials herein, and thus are preferably used at low levels, if at all, in the present compositions. The following are representative examples of surfactants useful in the present compositions.

Water-soluble salts of the higher fatty acids, i.e., "soaps", are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups). Examples of this group of synthetic surfactants are the sodium and potassium alkyl sulfates, especially those obtained by sulfating the higher alcohols ($C_8$-$C_{18}$ carbon atoms) such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11-13}$LAS.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin sulfonates containing from about 12 to 24 carbon atoms; and beta-alkyloxy alkane sulfonates containing from about 1 to 3 carbon atoms in the alkyl group and from about 8 to 20 carbon atoms in the alkane moiety.

Water-soluble nonionic surfactants are also useful in the compositions of the invention. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 12 moles of ethylene oxide per mole of alkyl phenol.

Preferred nonionics are the water-soluble condensation products of aliphatic alcohols containing from 8 to 22 carbon atoms, in either straight chain or branched configuration, with from 3 to 12 moles of ethylene oxide per mole of alcohol. Particularly preferred are the condensation products of alcohols having an alkyl group containing from about 9 to 15 carbon atoms with from about 4 to 8 moles of ethylene oxide per mole of alcohol.

Semi-polar nonionic surfactants include water-soluble amine oxides containing one alkyl moiety of from about 10 to 18 carbon atoms and two moieties selected from 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

Particularly preferred surfactants herein include linear alkylbenzene sulfonates containing from about 11 to 14 carbon atoms in the alkyl group; tallowalkyl sulfates; coconutalkyl glyceryl ether sulfonates; alkyl ether sulfates wherein the alkyl moiety contains from about 14 to 18 carbon atoms and wherein the average degree of ethoxylation is from about 1 to 4; olefin or paraffin sulfonates containing from about 14 to 16 carbon atoms; alkyldimethyl amine oxides wherein the alkyl group contains from about 11 to 16 carbon atoms; alkyldimethylammonio propane sulfonates and alkyldimethylammonio hydroxy propane sulfonates wherein the alkyl group contains from about 14 to 18 carbon atoms; soaps of higher fatty acids containing from about 12 to 18 carbon atoms; condensation products of $C_{9-15}$ alcohols with from about 4 to 8 moles of ethylene oxide, and mixtures thereof.

Specific preferred surfactants for use herein include: sodium linear $C_{11-13}$ alkylbenzene sulfonate; triethanolamine $C_{11-13}$ alkylbenzene sulfonate; sodium tallow alkyl sulfate; sodium coconut alkyl glyceryl ether sulfonate; the sodium salt of a sulfated condensation product of a tallow alcohol with about 4 moles of ethylene oxide; the condensation product of a coconut fatty alcohol with about 6 moles of ethylene oxide; the condensation product of tallow fatty alcohol with about 11 moles of ethylene oxide; 3-(N,N-dimethyl-N-coconutalkylammonio)-2-hydroxypropane-1-sulfonate; 3-(N,N-dimethyl-N-coconutalkylammonio)propane-1-sulfonate; 6-(N-dodecylbenzyl-N,N-dimethylammonio)hexanoate; dodecyldimethyl amine oxide; coconut alkyldimethyl amine oxide; and the water-soluble sodium and potassium salts of coconut and tallow fatty acids.

Aluminosilicate Ion Exchange Material

The detergent compositions herein also contain from about 5% to about 60%, preferably from about 10% to about 50%, and more preferably from about 15% to about 25%, by weight of crystalline aluminosilicate ion exchange material of the formula $$Na_z[(AlO_2)_z.(SiO_2)_y].xH_2O$$

wherein z and y are at least about 6, the molar ratio of z to y is from about 1.0 to about 0.5 and x is from about 10 to about 264. Amorphous hydrated aluminosilicate materials useful herein have the empirical formula $$M_z(zAlO_2.ySiO_2)$$

wherein M is sodium, potassium, ammonium or substituted ammonium, z is from about 0.5 to about 2 and y is 1, said material having a magnesium ion exchange capacity of at least about 50 milligram equivalents of $CaCO_3$ hardness per gram of anhydrous aluminosilicate.

The aluminosilicate ion exchange builder materials herein are in hydrated form and contain from about 10% to about 28% of water by weight if crystalline, and potentially even higher amounts of water if amorphous. Highly preferred crystalline aluminosilicate ion exchange materials contain from about 18% to about 22% water in their crystal matrix. The crystalline aluminosilicate ion exchange materials are further characterized by a particle size diameter of from about 0.1 micron to about 10 microns. Amorphous materials are often smaller, e.g., down to less than about 0.01 micron. Preferred ion exchange materials have a particle size diameter of from about 0.2 micron to about 4 microns. The term "particle size diameter" herein represents the average particle size diameter of a given ion exchange material as determined by conventional analytical techniques such as, for example, microscopic determination utilizing a scanning electron microscope. The crystalline aluminosilicate ion exchange materials herein are usually further characterized by their calcium ion exchange capacity, which is at least about 200 mg. equivalent of $CaCO_3$ water hardness/g. of aluminosilicate, calculated on an anhydrous basis, and which generally is in the range of from about 300 mg. eq./g. to about 352 mg. eq./g. The aluminosilicate ion exchange materials herein are still further characterized by their calcium exchange rate which is at least about 2 grains $Ca^{++}$ gallon/minute/gram/gallon of aluminosilicate (anhydrous basis), and generally lies within the range of from about 2 grains/gallon/minute/gram/gallon to about 6 grains/gallon/minute/gram/gallon, based on calcium ion hardness. Optimum aluminosilicate for builder purposes exhibit a calcium ion exchange rate of at least about 4 grains/gallon/minute/gram/gallon.

The amorphous aluminosilicate ion exchange materials usually have a $Mg^{++}$ exchange capacity of at least about 50 mg. eq. $CaCO_3$/g. (12 mg. $Mg^{++}$/g.) and a $Mg^{++}$ exchange rate of at least about 1 grain/gallon/minute/gram/gallon. Amorphous materials do not exhibit an observable diffraction pattern when examined by Cu radiation (1.54 Angstrom Units).

Aluminosilicate ion exchange materials useful in the practice of this invention are commercially available. The aluminosilicates useful in this invention can be crystalline or amorphous in structure and can be naturally-occurring aluminosilicates or synthetically derived. A method for producing aluminosilicate ion exchange materials is discussed in U.S. Pat. No. 3,985,669, Krummel et al, issued Oct. 12, 1976, incorporated herein by reference. Preferred synthetic crystalline aluminosilicate ion exchange materials useful herein are available under the designations Zeolite A, Zeolite B, and Zeolite X. In an especially preferred embodiment, the crystalline aluminosilicate ion exchange material has the formula $$Na_{12}[(AlO_2)_{12}(SiO_2)_{12}].xH_2O$$

wherein x is from about 20 to about 30, especially about 27.

The Enzyme

The pure enzyme component is incorporated herein in an amount of from about 0.005% to about 0.2%, preferably from about 0.02% to about 0.09%. The preferred proteolytic enzyme component should give to the composition a proteolytic activity of at least about 0.003 Anson Units per liter, preferably from about 0.003 to about 1.125 Anson Units per liter of wash solution. Most preferably, from about 0.016 to about 0.063 Anson Units per liter of wash solution. Above about 0.1 Anson units per liter of wash solution additional pure enzme provides only minimal increase in performance. Other enzymes including amylolytic enzymes can also be included.

Preferably the enzyme component is characterized by an isoelectric point of from about 8.5 to about 10, preferably from about 9 to about 9.5.

Examples of suitable proteolytic enzymes include many species which are known to be adapted for use in detergent compositions and, in fact, have been used in detergent compositions. Sources of the enzymes include commercial enzyme preparation such as "Alcalase", sold by Novo Industries, and "Maxatase", sold by Gist-Brocades Delft, The Netherlands, which contain from about 10% to about 20% enzyme. Other enzyme compositions include those commercially available under the trade names SP-72 ("Esperase"), manufactured and sold by Novo Industries, AS, Copenhagen, Denmark, and "AZ-Protease", manufactured and sold by Gist-Brocades Delft, The Netherlands.

A more complete disclosure of suitable enzymes can be found in U.S. Pat. No. 4,101,457, Place et al, issued July 18, 1978, incorporated herein by reference.

The Nitrilotriacetate

Nitrilotriacetates are well known detergency builders. The water-soluble salts useful herein include the sodium, potassium, ammonium, monoethanolammonium, diethanolammonium, and triethanolammonium salts and mixtures thereof. The nitrilotriacetate is present at a level of from about 1% to about 60%, preferably from about 5% to about 50%. The weight ratio of aluminosilicate ion exchange material to nitrilotriacetate is generally from about 4:1 to about 1:4, preferably from about 3:1 to about 1:3. An approximate 1:1 ratio is very desirable.

Other ingredients commonly used in detergent compositions can be included in the compositions of the present invention. These include color speckles, bleaching agents, and bleach activators, suds boosters, or suds suppressors, anti-tarnish and anti-corrosion agents, soil suspending agents, soil release agents, dyes, fillers, optical brighteners, germicides, pH adjusting agents, non-builder alkalinity sources, additional builders, hydrotropes, enzyme stabilizing agents, and perfumes.

All percentage, parts, and ratios used herein are by weight unless otherwise specified.

The following nonlimiting examples illustrate the detergent compositions of the present invention.

EXAMPLE I

A comparison of enzyme effectiveness was made using a base formula (A) containing:

20% of an anionic detergent mixture of
(1) 1.5% sodium tallow alkyl sulfate;
(2) 12.5% sodium $C_{11.8}$ alkylbenzene sulfonate; and
(3) 6.0% sodium $C_{16-18}$ alkyl polyethoxy(3.0) sulfate;
20.0% sodium silicate solids (2.4 r);
20.0% sodium carbonate;
31.5% sodium sulfate; and
balance moisture and minors.

This base formula was compared to other formulas in which the indicated percentages of builders were added.

B. 36.0 parts hydrated Zeolite A, average particle size of about 3 microns (Zeolite A)
C. 23.6 parts sodium nitrilotriacetate (NTA)
D. 14.3 parts sodium nitrilotriacetate and 14.3 parts Zeolite A.
E. 17.4 parts sodium tripolyphosphate (STP) and 17.4 parts Zeolite A.

Novo Alkalase marumerized enzyme was admixed at 0.8 parts (0.025 Anson units per liter). The wash solution pH was adjusted to 9.8 with HCl prior to addition of the soiled swatches. Washing was conducted in automatic mini-washers at 95° F. and at 4, 8, and 12 grain hardness.

The soils tested were grass and blood.

Cleaning Boost on Grass Stain - PSU Grade*
(With Enzyme Minus Without Enzyme)

| | | 4 grain | 8 grain | 12 grain |
|---|---|---|---|---|
| A | Base Formula | 2.0 | 1.8 | 1.0 |
| B | A + Zeolite A | 4.0 | 2.5 | 1.3 |
| C | A + NTA | 5.2 | 5.0 | 6.0 |
| D | A + NTA/Zeolite A | 4.7 | 4.7 | 4.3 |
| E | A + STP/Zeolite A | 3.5 | 2.5 | 0.5 |

*PSU grades based on visual round robin comparison grading with possible scores ranging from −4 to +4.

Relative Cleaning on Grass Stains - PSU Grades*

| | | 4 grain | 8 grain | 12 grain |
|---|---|---|---|---|
| A[1] | Base Formula | 1.0 | Base | −0.8 |
| B | A[1] + Zeolite A | 3.5 | 2.0 | −0.5 |
| C | A[1] + NTA | 4.7 | 4.7 | 4.7 |
| D | A[1] + NTA/Zeolite A | 4.7 | 4.7 | 3.5 |
| E | A[1] + STP/Zeolite A | 3.2 | 2.0 | −0.5 |

*PSU grades based on visual round robin comparison grading with possible scores ranging from −4 to +4.

The above data clearly show that there is a surprising builder/enzyme interaction not previously suspected. The NTA/enzyme interaction is surprisingly large and the benefit of the NTA is not lost when the level of NTA is reduced and Zeolite A replaces it. The benefit on blood was similar but less dramatic because of the greater effectiveness of the enzyme on blood. The combination is surprisingly better than the combination of sodium tripolyphosphate, Zeolite A, and enzyme.

What is claimed is:

1. A detergent composition substantially free of phosphate materials comprising:

(a) from about 5% to about 40% of a detergent surfactant selected from the group consisting of anionic, nonionic, zwitterionic, ampholytic and cationic surfactants and mixtures thereof;

(b) from about 0.005% to about 0.2% of pure proteolytic enzyme;

(c) from about 10% to about 50% of a hydrated sodium Zeolite A; and (d) from about 5% to about 30% of a water-soluble nitrilotriacetate, the ratio of the hydrated sodium zeolite A to the water soluble nitrilotriacetate being from about 1:3 to about 3:1.

2. The composition of claim 1 wherein said enzyme is at a level of from about 0.02% to about 0.09%.

3. The composition of claim 1 wherein the said enzyme is at a level of from about 0.02% to about 0.09%.

4. The composition of claim 1 wherein the surfactant is from about 10% to about 20%, and the Zeolite A is from about 15% to about 25%.

5. The composition of claim 1 wherein the enzyme is present at from about 0.02% to about 0.09% and the ratio of the Zeolite A to the nitrilotriacetate is from about 1:3 to about 3:1.

* * * * *